US005930846A

United States Patent [19]

Warren-Pfaeffle et al.

[11] Patent Number: 5,930,846

[45] Date of Patent: Aug. 3, 1999

[54] WHEELCHAIR AND WATER CLOSET CHAIR WITH REMOTE CONTROL SLIDING MEMBERS CLOSING A GAP

[76] Inventors: Patricia E. Warren-Pfaeffle, 72 S. Charles St., Hopelawn, N.J. 08861; Thomas Peter Pfaeffle, 2081 Whitman Way, Apt. 121, San Bruno, Calif. 94066

[21] Appl. No.: 08/948,773

[22] Filed: Oct. 10, 1997

Related U.S. Application Data

[62] Division of application No. 08/565,691, Dec. 1, 1995, Pat. No. 5,820,152.

[51] Int. Cl.[6] ..... E03D 11/00

[52] U.S. Cl. ..... 4/254

[58] Field of Search ..... 4/254; 280/250.1

[56] References Cited

U.S. PATENT DOCUMENTS

| | | | |
|---|---|---|---|
| 4,266,305 | 5/1981 | Kavaloski et al. | 4/254 X |
| 5,419,571 | 5/1995 | Vaughan | 280/250.1 |

*Primary Examiner*—Robert M. Fetsuga
*Attorney, Agent, or Firm*—Corbin & Gittes

[57] ABSTRACT

A water closet chair that has arms that may be selectively raised and lowered and a water closet chair that has handgrips that may be selectively raised and lowered. The arms and handgrips have extensions movable towards each other to effect engagement with each other. In addition, each has sensors that sense when the extensions of each are in alignment with each other.

5 Claims, 3 Drawing Sheets

WHEELCHAIR AND WATER CLOSET CHAIR WITH REMOTE CONTROL SLIDING MEMBERS CLOSING A GAP

This is a Division of application Ser. No. 08/565,691, filed Dec. 1, 1995, U.S. Pat. No. 5,820,152.

BACKGROUND OF THE INVENTION

The present invention relates to aids for persons using wheelchairs, including a stable support connection that extends across a gap between aids. Such a connection secures together handgrips of an aid, such as a water closet chair, with arms of another aid, such as a wheelchair. It assists such disabled or partially disabled persons in transferring themselves from one aid to another in that the gap between such aids is transversed by the stable connection, which may be grapsed while pulling one's body across the gap between he aids.

Persons who use wheelchairs may have difficulty transferring themselves between various aids or devices, such as a wheelchair, a water closet chair. Often, there is a gap between the aid or device which the person is going to and the aid or device that the person is leaving. As a result, the person must reach across this gap to grasp the aid or device at the other side, thereby adversely affecting the leverage that the person has to pull or carry his/her weight across the gap.

SUMMARY OF THE INVENTION

The present invention is directed to aids for disabled or partially disabled persons.

One aspect of the invention resides in an aid having cooperating elements that engage each other to form a sturdy, stable connection across a gap between spaced apart aids. The cooperating elements are part of handgrips of a water closet chair and arms of a wheelchair or water closet chair. Sensors are provided to sense alignment for effecting the engagement of the cooperating elements and an indicator makes an indication accordingly when the sensors are in alignment between different ones of the aids or devices.

Another aspect resides in an aid in the form of a wheelchair or water closet chair, each having arms or handgrips movable relative to their frames and having sensors that sense alignment of the sensors with others that are external to the frame, such as those on another aid. The alignment triggers an indications that the arms or handgrips may be moved into engagement with those of another.

BRIEF DESCRIPTION OF THE DRAWINGS

For a better understanding of the present invention, reference is made to the following description and accompanying drawings, while the scope of the invention is set forth in the appended claims.

DESCRIPTION OF THE PREFERRED EMBODIMENT

Figure 1:
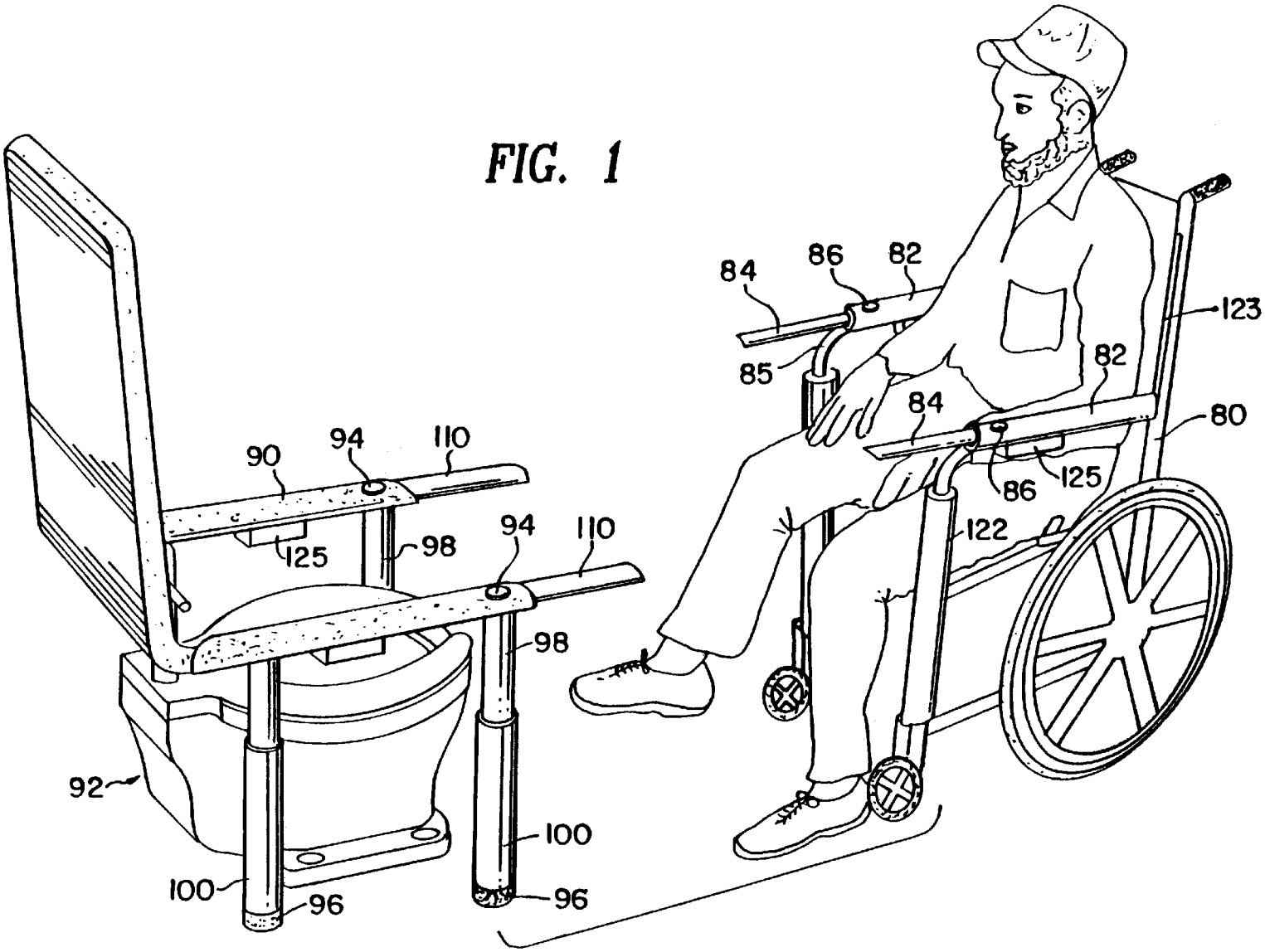
FIG. 1 is a perspective view of a person in a wheel chair approaching a water closet chair that has two hand grips.

The preferred embodiment is depicted in FIGS. 1–5. FIG. 1 shows the wheelchair 80 in a separated position relative to the water closet chair 92. Each has cooperating elements that provide for a stable connection therebetween in the manner shown in FIG. 2. The cooperating elements include the pair of arms of the wheelchair and the pair of handgrips of the water closet chair; at least one pair of the arms and handgrips are movable relative to the other to span a two to three foot distance. Although a man is shown in the wheelchair in preparation for using the invention to transfer to the water closet chair, the invention also may be used by females in the same manner.

The frame of the wheelchair So may include an arm housing 82, a movable arm extension 84 that is movable relative to the arm housing 82, an arm rod 85 that is movable relative to a vertically extending sleeve 122, two buttons 86 to actuate a respective motorized driver 125 on the underside of an associated one of the arm housings 82 and a motorized driver (not shown) for moving the arm rod 85 relative to the sleeve 122. An end of each of the arm housings 82 fit within a respective groove 123 (see FIG. 1) at the backrest support rods of the chair to guide the arm housings during raising and lowering caused by the arm rod 85 being driven by the drive mechanism.

Figure 2:
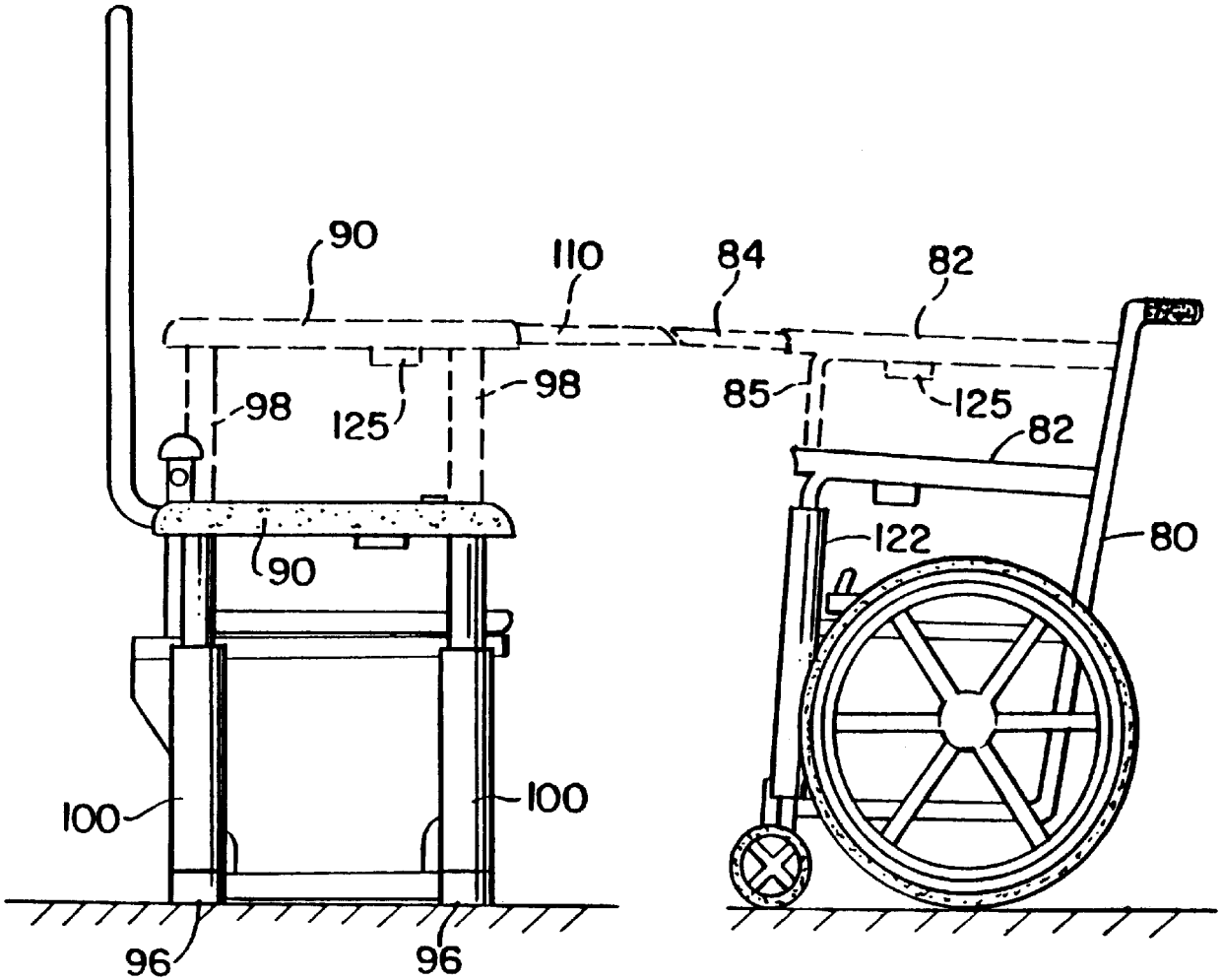
FIG. 2 is an elevational side view of the hand grips and wheelchair arms, with their raised position shown in phantom.

These movements of the wheelchair arm rods 85 and the sliding members 110 are represented by phantom lines in FIG. 2. In the fully retracted position of the arm rod 85, the movable arm extension 84 is shown in its fully retracted position as well. In the fully extended position of the arm rod 85, the movable arm extension 84 is shown in its fully extended position.

The water closet chair 92 may include a handgrip 90, a sliding member 110 that is slidingly movable relative to the handgrip 90, and a vertical extension 98 that is movable relative to a vertical housing 100 by actuation of a motorized driver or drivers 96. The sliding member 110 moves in response to actuation of a motorized driver or drives 125 on the underside of the handgrip 90 and may be identical to that on the underside of the wheelchair arm housing 82.

The movements of the handgrips and the sliding members is represented by phantom lines in FIG. 2. In the fully retracted position of the vertical extension 98, the sliding members 110 are shown in a fully retracted position as well, but in the fully extended position of the vertical extension 98, the sliding members 110 are shown in a fully extended position as well.

Figure 4:
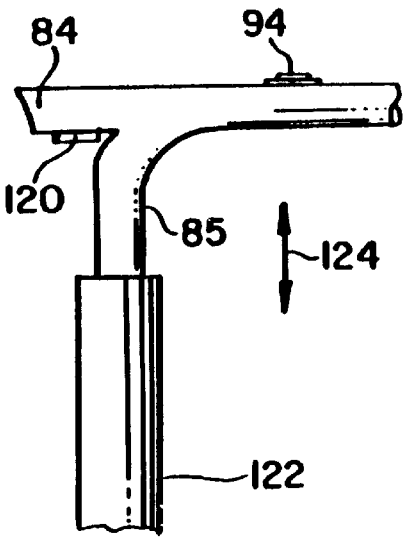
FIG. 4 is a cross-section across 15—15 of FIG. 3.
Figure 3:
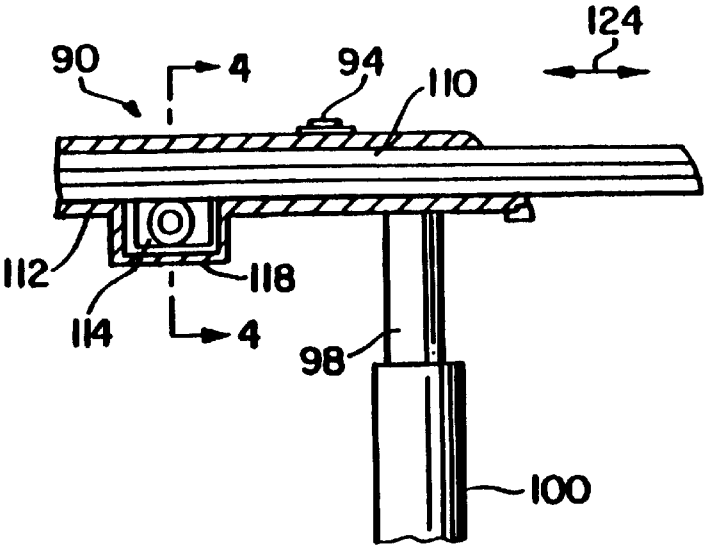
FIG. 3 is a partially broken elevational side view of a portion of the hand grip support of FIG. 2 with the hand grip support in a raised position and aligned with the wheelchair arms.
Figure 5:
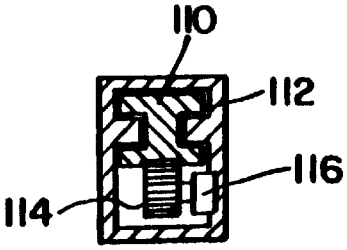
FIG. 5 is a partial elevational view of the wheelchair arms of FIG. 2 in a raised position and aligned with the hand grip support.

FIGS. 3, 4, and 5 show the sliding member 110 to be I-shaped within a handgrip housing 112 and driveable by a wheel 114 that is rotatably driven by a motorized driver 116. The motorized driver and wheel may be enclosed within a compartment 118. Light sensors 120 on the handgrip and the wheelchair movable arm extension 84 face each other and transmit signals in a conventional manner to an indicator (no shown) when they become aligned or engagement. The wheelchair arm 82 may be raised or lowered with respect to its sleeve 122 (see FIGS. 2 and 5). Appropriate actuation buttons 94 (see FIGS. 3 and 5) are provided to align the light sensors 120 and engage the wheelchair movable arm extension 84 and sliding member 110. Movements are indicated by direction arrows 124.

The light sensors 120 may be arranged either on the extension 84 and sliding member 110 or on the arm rod 85 and vertical extension 98 so as to sense when the sensors 120 are aligned and thereby that the extension 84 and sliding member 110 are in position for engaging each other. The sensors 120 may be equipped with an indicator (not shown) that makes an indication when the sensors are aligned. For example, the indication may be audible, visual or vibratory. The indicator may be part of the sensor itself.

The actuation buttons 86, 94 are exemplary and may be four-way switches operable in that depressing the buttons may result in lowering, pulling the buttons upwardly may result in raising, sliding/pressing the buttons forwardly may result in outward movement of the sliding/pressing member 110 or movable arm extensions 84 as applicable, and sliding the buttons rearwardly may result in inward movement of the sliding member 110 into a handgrip 90 or arm extension 84 into a wheelchair arm 82 as applicable. Instead of a signel button responsible for actuating movements in all directions, multiple buttons may be provided with each responsible for a single direction of movement or for opposite direction of movements.

In addition to the possibility of the wheel chair movable arm extensions 84 engaging the water closet chair sliding member 110, they may be configured to engage instead the water closet chair handgrips directly. The result of the engagement is a stable connection for supporting the weight of the disabled or partially disable person as he/she transfers himself/herself between the wheelchair and water closet chair. Sensors 120 should be used to indicate alignment for positioning purposes.

While the foregoing description and drawings represent the preferred embodiments of the present invention, it will be understood that various changes and modifications may be made without departing from the spirit and scope of the present invention.

What is claimed is:

1. An apparatus to aid persons who use a water closet chair, comprising: a water closet chair that includes a pair of water closet handgrips; at least one driver that raises and lowers the handgrips between different elevations relative to a remainder of the water closet chair; and a pair of water closet chair sliding members attached to said handgrips so as to be movable between a retracted position and a fully extended position relative to said handgrips and being movable in unison with said water closet handgrips as said water closet handgrips are raised and lowered between said different elevations.

2. An apparatus as in claim 1, further comprising at least one further driver that drives the water closet sliding members in opposite directions between the retracted and fully extended positions.

3. An apparatus as in claim 2, further comprising sensors operative to sense a relative position in which said handgrips and said extensions of a wheelchair are in alignment with each other.

4. An apparatus as in claim 3, wherein said sensors are attached to said handgrips.

5. An apparatus as in claim 1, wherein said handgrips are configured to engage extensions of wheelchair arms.

* * * * *